US005289239A

United States Patent [19]

Day

[11] Patent Number: 5,289,239

[45] Date of Patent: Feb. 22, 1994

[54] INTEGRATED AIR KNIFE TONER APPLICATOR

[75] Inventor: Gene F. Day, Hillsborough, Calif.

[73] Assignee: Phoenix Precision Graphics, Inc., Sunnyvale, Calif.

[21] Appl. No.: 28,379

[22] Filed: Mar. 9, 1993

Related U.S. Application Data

[63] Continuation-in-part of Ser. No. 930,779, Aug. 17, 1992, Pat. No. 5,231,455.

[51] Int. Cl.[5] ..... G03G 15/00

[52] U.S. Cl. ..... 355/256; 118/659

[58] Field of Search ..... 355/256; 118/659, 660

[56] References Cited

U.S. PATENT DOCUMENTS

| | | | |
|---|---|---|---|
| 3,196,832 | 7/1965 | Zin | 118/660 |
| 4,247,191 | 1/1981 | Grace et al. | 355/256 X |
| 4,870,462 | 9/1989 | Day | 355/256 |
| 4,878,090 | 10/1989 | Lunde | 355/256 |
| 5,063,413 | 11/1991 | Domoto et al. | 355/296 |

*Primary Examiner*—Joan H. Pendegrass

*Attorney, Agent, or Firm*—Schneck & McHugh

[57] ABSTRACT

In electrostatic liquid toning, an apparatus for removing excess liquid toner from a recording medium using an air knife integrated with a toner applicator into a single mechanical structure. The toner applicator contains a toning channel and an air channel adjacent to a toner drain channel. The recording medium carrying a latent electrostatic image is directed past the toning channel in the toner applicator. The toning channel in the applicator contains toner and is in fluid communication with the recording medium. Air under pressure is expelled through the air channel and against the recording medium such that excess toner deposited onto the surface of the recording medium is directed into the toner drain channel.

3 Claims, 2 Drawing Sheets

INTEGRATED AIR KNIFE TONER APPLICATOR

CROSS REFERENCE TO RELATED APPLICATION

This is a continuation-in-part of patent application Ser. No. 07/930,779 filed Aug. 17, 1992 now U.S. Pat. No. 5,231,455.

TECHNICAL FIELD

The present invention pertains to the field of electrostatic printing and copying. Specifically, the present invention pertains to the removal of toning fluids from a recording medium in electrostatic printing and copying.

BACKGROUND ART

In electrostatic printing and copying systems, an electrostatic writing head is commonly used to deposit a latent image of electrical charges onto a recording medium such as a paper web. The paper web carrying the latent image is then directed to a liquid toning applicator which deposits charged toner particles onto the paper web, thereby developing the latent image. The paper web may then be passed to a separate structure containing an air knife which uses the shearing force produced by a stream of high pressure air expelled over a knife edge surface to remove excess toner remaining on the surface of the recording medium. Air knives are well known in the art for removing liquids from moving webs in industrial applications such as oil removal from metal webs in aluminum rolling mills. Additionally, U.S. Pat. No. 4,870,462 to G. F. Day teaches the use of air knives for removing liquid toner from a recording medium.

Although air knives are useful for removing excess toner, air knife structures, which are separate from the applicator structure, also increase the size and cost of electrostatic printing and copying systems. Because the air knife is separate from the applicator, costs associated with manufacturing an additional mechanical structure are incurred. Additionally, separate toner drain lines or buckets to hold the excess toner removed from the recording medium by the air knife are required. The implementation and use of such drain lines and buckets increase the cost of the toner system. Furthermore, the drain lines and buckets also require occasional cleaning.

Air supply means must also be provided for the air knife. A separate air supply means, such as a blower or an air pump, may be used, or the air knife may be coupled to a pump or blower present in the toner applicator using connecting hoses or plumbing. In either case, the use of an air knife separate from the toner applicator adds additional components to the toner system. The additional components lead to an increase in the size and cost of the applicator system.

The problems associated with separately arranged air knives are compounded in single-applicator systems in which a single applicator is used to apply multiple colored toners to a recording medium. As mentioned above, the air knife must be provided with a separate drain line or bucket to receive the toner removed by the air knife from the recording medium. However, in order to avoid mixing of the various colored toners, the drain line or bucket of the air knife must be cleaned after each application of differently colored toner to the recording medium. This cleaning process is both difficult and time consuming.

The use of a separately situated air knife is also inefficient in a positive air pressure toner applicator system such as is described in co-pending U.S. Pat. application Ser. No. 07/998,458. In such a system, positive air pressure is used to confine the toner fluids to the surface of the applicator. Air is expelled at the edges of the applicator surface, at a pressure greater than the pressure of the fluids confined within the applicator. The high pressure air prevents fluid leakage from the edges of the toner applicator, thereby eliminating the need for a funnel or bucket to catch spilled toner. In so doing, a difficult cleaning problem is eliminated, and a single applicator may be used for multiple color toning. However, because the air knife is separate from the applicator, a pressurized air channel and drain line must be provided at the web exiting edge of the applicator to prevent toner leakage from that edge in order to avoid the need for a funnel or a bucket. Additionally, an air channel and a toner drain line or bucket must be provided in the air knife as well. Thus, using a separately situated air knife requires forming one air channel and drain line for the applicator, and a second air channel and drain line or bucket for the air knife.

Therefore it is an object of this invention is to provide a low-cost air knife for removing excess toner from a recording medium which does not increase the size or manufacturing requirements of the toner system.

A further object of this invention is to provide such an air knife which reduces the number of air channels and drain lines or buckets required in positive pressure toner applicator systems.

SUMMARY OF THE INVENTION

This object has been achieved with a low-cost integrated air knife and toner applicator system for an electrostatic printer or copier which allows the air knife and toner applicator to share a common air supply and drain lines in a compact single mechanical structure. This is accomplished by forming the air channel of the air knife into the web exiting edge of the toner applicator next to the toner drain channel of the applicator. The air channel is formed across said applicator, such that the toner drain channel is disposed between the air channel of the air knife and toning channel of the applicator. The air channel of the air knife is also formed having a length equal to the width of the web, such that air may be directed across the entire surface of the web as the web passes over the air channel.

A single air supply may be used for both the applicator and the air channel of the air knife. Air is expelled through the air channel and against the surface of the paper web as it passes over the air channel of the air knife. The best configuration is to provide toner flow towards the knife edge, i.e. parallel to the paper direction, so that the liquid and the air flow towards each other. The shear force of this air moving at high speed against the paper motion effectively dries the paper web. The mixture of excess toner removed from the web and air expelled from the air channel passes into the toner drain channel. Thus, the applicator and the air knife share a common toner drain channel.

Additionally, by forming the air channel of the air knife on the web exiting edge of the applicator, the air knife helps to confine the toner to the toning channel of the applicator and prevents the toner from leaking over the web exiting edge of the applicator. As a result, the air knife reduces the number of air channels and drain lines or buckets required in positive pressure toner applicator systems.

In an alternate embodiment, four surrounding air knives are used such that the entire toning channel of the applicator is surrounded by air knives. The shear force of the air against the paper effectively prevents any toner leakage. However, it is generally more economical to employ flat sealing surfaces around the toner channel of the applicator, except where actual liquid removal is needed, i.e. along the downstream edge of the applicator where the wet paper exits the applicator.

BEST MODE FOR CARRYING OUT THE INVENTION

Figure 1:
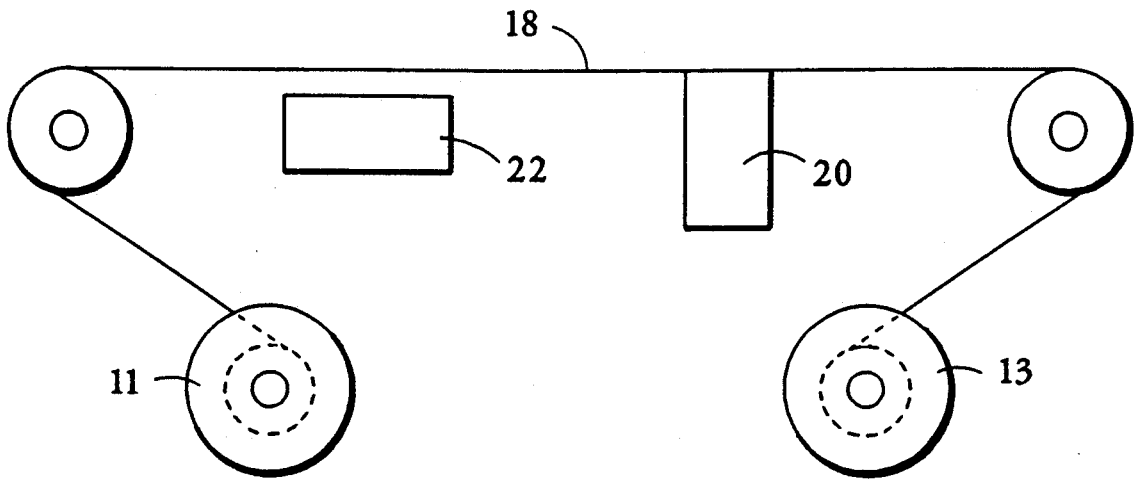
FIG. 1 is a simplified schematic view of an electrostatic printing and copying apparatus having an integrated air knife and toner applicator in accord with the present invention.

With reference to FIG. 1, an electrostatic printing and copying system is shown, utilizing an integrated air knife and toner applicator in accord with the present invention. Paper supply roller 11 and take-up roller 13 accurately position a paper web 18, and maintain tension in the web 18. Toner applicator 20 having an air knife integrated therein spans the width of paper web 18. Liquid toner is supplied to applicator 20 and flows across the entirety of an exposed upper applicator surface, a toning channel, allowing toner particles to adhere to charged regions of the paper. An electrostatic writing head 22 is located upstream from toner applicator 20. Head 22 is a scanning head which moves across the width of the paper 18, similar to scanning heads of dot matrix printers. However, instead of applying ink to paper by means of a ribbon, head 22, having an array of closely spaced wires connected to a high voltage supply, merely deposits an electrostatic charge in an analogous manner, thereby writing a latent image on paper web 18. Although the following description pertains to the use of a paper web, the present invention may also be used with drum-type electrostatic systems.

Figure 2:
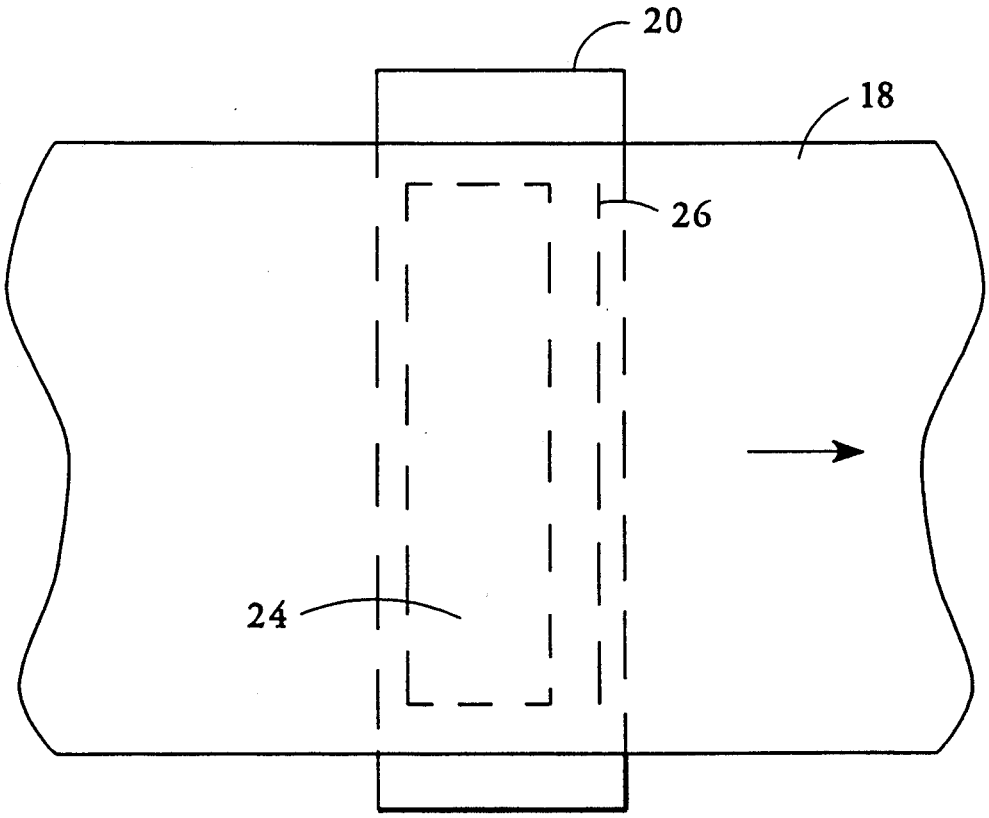
FIG. 2 is a top view of the integrated air knife and toner applicator of FIG. 1 in accord with the present invention.

Referring now to FIG. 2, a partial top view of FIG. 1 is shown in which the alignment of paper web 18 over toner applicator 20 and integrated air knife 26 is more clearly illustrated. As can be seen in FIG. 2, toner applicator 20 has a length which spans the entire width of paper web 18. Applicator 20, having a toning channel defined by area 24, applies liquid toner across the entire width of web 18 except for small border regions at each edge. Paper web 18 is controlled so that it moves across toner applicator 20 such that the entire image surface of the web 18 has toner applied thereto via applicator 20.

Liquid toner in applicator 20 includes charged particles in suspension which adhere to oppositely charged small regions of the latent image. Air knife 26, residing on applicator 20, removes excess toner from web 18 at the downstream edge of applicator 20. After the excess toner has been removed, another pass is made where the next color is written, until all colors have been written in the same way to form a fully developed image. Between passes an air jet cleaner system is used to purge toner from the toner pump, slits and piping to be shared with the next color. Wash fluid is then introduced in order to dissolve any residual toner so as to leave the pump, slits, and piping in a clean condition. Jet air is then reintroduced to purge the wash fluid so as to prepare the shared areas for the next color.

Figure 3:
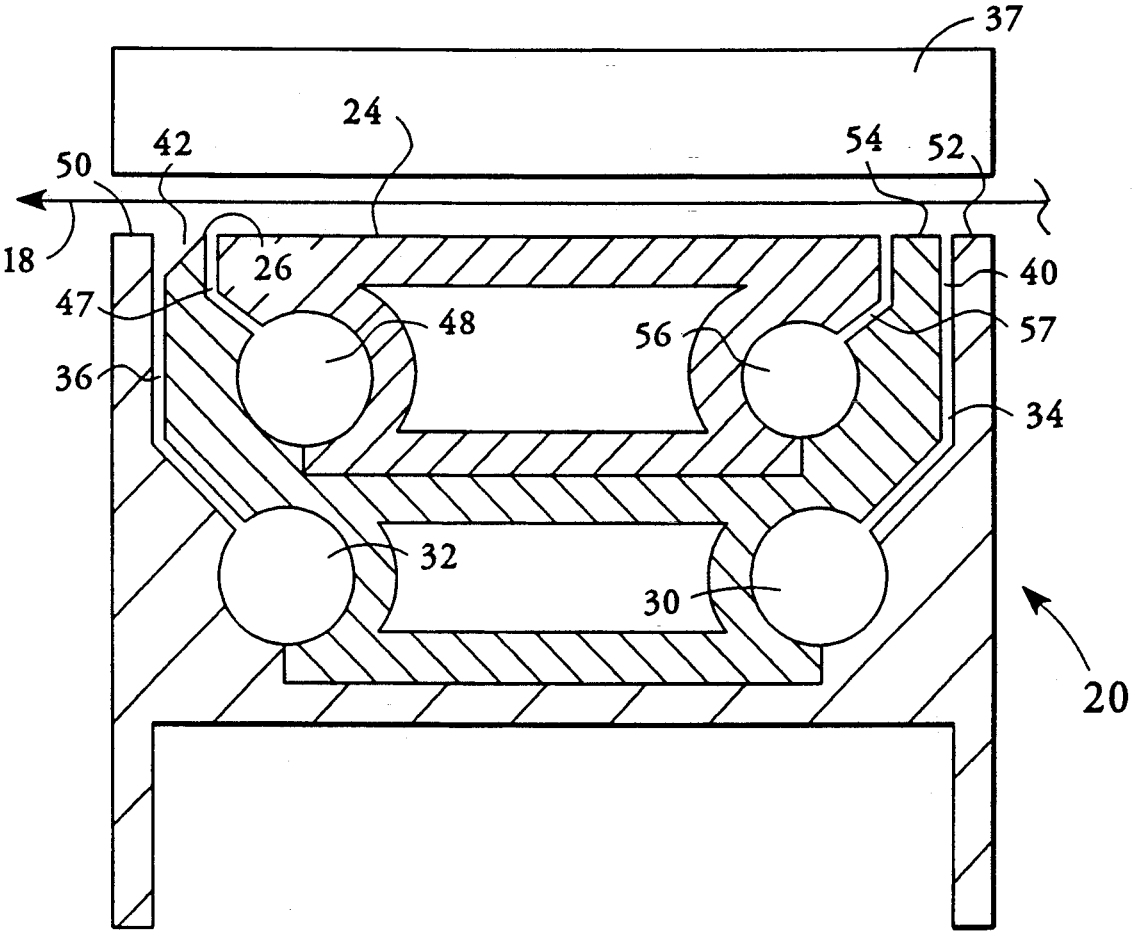
FIG. 3 is a side sectional view of an integrated air knife and toner applicator in accord with the present invention.

Following is a more detailed description of the above-mentioned procedure. With reference now to FIG. 3, a side sectional view of the positive air pressure toner applicator 20 of the present invention is shown. Although air knife 26 is integrated with a positive air pressure applicator 20, in the preferred embodiment, the present invention is also well suited for use with other types of toner applicators well known in the art. Air from an air supply means, not shown, is supplied to airways 30 and 32. In practice the air supply means is a blower such as the RDC Revaflow Radial Blower, Model RDC12HH, manufactured by EG&G Rotron, Saugerties, New York. Airways 30 and 32 maintain a volume of air therein. When needed, the air is pumped or blown upward through airway slits 34 and 36 until it reaches the upper surface of applicator 20 which contacts paper web 18. The air pressure at the topmost ends 40 and 42 of airway slits 34 and 36 is maintained by the air supply means at no less than 0.2 pounds per square inch, and preferably at 0.3 pounds per square inch. Since the liquids are pumped to channel 24 at a pressure of preferably below about 0.1 pounds per square inch, the liquid is fully contained to channel area 24 and does not leak beyond the long edges of applicator 20.

By using a positive air pressure applicator, the present invention is not limited by the narrow channels required in suction type applicators. For instance, channel 24 can be almost the full size of the contacting surface of applicator 20. That is, channel 24 may be formed on applicator 20 extending across the entire width of paper web 18, i.e. along almost the entire length of applicator 20, and across almost the entire width of applicator 20, its width being in the direction of movement of web 18. One such "full-width" channel can be as effective as ten or twenty smaller cross-flow channels used in suction type applicators, and almost totally eliminate paper sliding friction.

At the near and far ends of applicator 20, U-shaped passages or channels, open at the top, are provided in the upper surface of the ends of applicator 20 in such a manner as to connect topmost ends 40 and 42 with each other at both the near and the far ends of the applicator 20. These two channels together with the topmost ends 40 and 42 of airway slits 34 and 36 form a rectangular curtain or "moat" as seen from above, of high pressure air which completely surrounds the wet, exposed toning channel 24 of applicator 20 preventing liquid leakage beyond the long edges or the narrow ends of applicator 20. This air moat eliminates the need for a bucket to catch any spilled toner and provides for a completely closed toning system in which the toner is fully captured even when in contact with moving paper web 18.

Paper web 18 is positioned in direct planar contact with the upper surfaces of applicator 20 to substantially prevent air leakage and loss except for the air which escapes inward over air knife 26 and into drainage channel 47. Air knife 26 is located next to airway slit 36. Airway slit 36 is formed having a width of approximately 0.02 inches. In so doing, the air expelled from airway slit 36 will move to the right over knife edge 26 and against paper web 18 at a velocity preferably greater than 100 feet per second. The air expelled from airway slit 36 removes excess toner from the surface of paper web 18, as web 18 passes over knife edge 26. Furthermore, integrating air knife 26 and applicator 20 allows air knife 26, utilizing air expelled from airway slit 36, to act as a barrier and confine liquid toner to toning channel 24 along the downstream web exiting edge of applicator 20. Additionally, air knife 26 and the rest of the channels surrounding toning channel 24 may share a common air supply means. Because a common air supply means is used, the amount of plumbing or connecting hoses may also be reduced. Since only one air supply means is necessary, the size of the toner system can be reduced as well. Therefore, the integrated air knife and toner applicator of the present invention allows both the cost and the size of the toner system to be reduced.

An added benefit of the integrated air knife 26 and applicator 20 of the present invention is that the closed toning system is easily self-cleaned by wash fluid so that manual cleaning is not required. Wash fluid may be introduced into toning channel 24 of applicator 20, drawn through drainage channel 47 and into drainage way 48. Thus, the present invention not only eliminates the need for separate buckets or drain lines for air knife 26, but also allows common drainage channel 47 and drainage way 48 of applicator 20 and air knife 26 to be easily cleaned.

Fresh toner is supplied by a pump, not shown, to toner supply way 56. Toner supply way 56 acts as a toner conduit. Toner is carried in toner supply way 56 and, when needed, toner is pumped upward through toner supply slit 57 as shown until it reaches paper web 18. The high pressure air, preferably greater than 0.2 pounds per square inch, at topmost end 40 prevents the toner, supplied at a pressure of preferably less than about 0.1 pounds per square inch from moving to the right so that it is forced to travel to the left towards topmost end 42. Upper surface 54 which actually contacts paper web 18 substantially prevents air from topmost end 40 from leaking into the wet toning channel area 24 to the left of upper surface 54. A small amount of air may leak into wet toning channel area 24 where it does no harm.

While the toner travels from the toner delivery slit 57, which communicates with toner supply way 56, towards air knife 26, the actual toning process takes place with a portion of the charged toner particles adhering to the charged latent image. For this purpose, toning channel 24 of applicator 20 is spaced away from paper 18, that is, it is recessed slightly below the plane of upper contacting surfaces 50, 52, and 54. The resulting space or gap between the image surface of paper 18 and toning channel 24 is preferably in the range 0.003 inches to 0.010 inches and ideally 0.004 to 0.005 inches. Smaller spacings tend to impede fluid flow such that insufficient toner is available for complete toning whereas larger spacings cause a slowing of the toning process resulting in similarly incomplete toning.

The flowing toner approaches knife edge 26 which is spaced away from paper surface 18 by a spacing similar to the spacing of toning channel 24 away from paper 18, i.e. by 0.003 to 0.010 inches and preferably by 0.004 to 0.005 inches. Between toning channel 24 and knife edge 26, drainage channel 47 is positioned so as to allow fluids to freely descend to drainage way 48. Drainage way 48 receives and holds the mixture of toner and air such that the toner may be cleaned or discarded from applicator 20. The drainage channel 47 is preferably wider than 0.010 inches in thickness so as to not impede air flow, liquid flow, or a mixed flow downward to drainage way 48. In this manner, the total fluid pressure at the top of drainage channel 47 which separates toning channel 24 from knife edge 26 is kept very low, preferably below 0.1 pounds per square inch. All the connecting lines and passages, not shown, which deliver air to topmost end 42 are preferably greater than 0.5 inches in internal diameter. In so doing, the desired air supply of no less than 0.2 pounds per square inch and preferably 0.3 pounds per square inch of air pressure at topmost end 42 is maintained.

This air at relatively high pressure moves to the right between air knife 26 and paper web 18 at a velocity preferably greater than 100 feet per second and both the liquid arriving from the right and the air arriving from the left of drain channel 47 descend downward to drainage way 48. Because the air knife is as wide as the paper web, the amount of air flowing between it and the paper is large, typically 5 to 10 cubic feet per minute. The shear force of the air passing between knife edge 26 and paper 18 insures that substantially all of the liquid is removed from paper web 18 resulting in only a very thin film of liquid being carried away with moving paper web 18. With paper web 18 moving to the left parallel to the flow of toner in the gap separating paper web 18 from toning channel 24, at a speed of about 2 inches per second, the residual film of liquid remaining on paper web 18 is preferably less than 0.00004 inches in thickness. A planar backing member 37, above, i.e. behind the paper 18 holds the paper flat and causes it to resist the pressure of the air and the liquids.

Thus, the present invention provides a low-cost integrated air knife and toner applicator in a single compact mechanical structure which effectively removes excess toner from the surface of a recording medium such as a paper web. Additionally, the present invention provides an air knife which operates efficiently with positive air pressure toner systems.

I claim:

1. A toner applicator for an electrostatic recorder or copier comprising:

a toner applicator body having a length spanning the entire width of a recording medium, and having a toning channel extending across a portion of said applicator body in the lengthwise direction in fluid communication with said recording medium for applying toner thereto, said toning channel spanning the entire width of said recording medium except for border regions at the edge of said recording medium, a first air channel in said toner applicator body, said first channel peripherally surrounding the two opposing widthwise sides and one of the lengthwise sides of said toning channel, a toner drain channel extending in the lengthwise direction across said toner applicator body for draining toner from said toning channel, said drain channel bordering eh other lengthwise side of said toning channel, an air knife integral to said toner applicator body, said air knife having a sharp edge extending in the lengthwise direction across said toner applicator body for removing excess toner from said recording medium with a high velocity air flow, said air knife having a second air channel extending lengthwise across said applicator body, said second air channel arranged such that said drain channel is disposed between said second air channel and said toning channel and such that said first and second air channels are in communication and peripherally surround said toning channel, and air supply means for expelling air through said first and second air channels surrounding said toning channel such that said toner is confined within said toning channel, said air expelled from said second air channel also removing said excess toner from said recording medium as said recording medium passes over said second air channel, such that said excess toner is directed into said toner drain channel.

2. The toner applicator of claim 1 wherein said recording medium is held at a distance of approximately 3 to 10 thousandths of an inch from said air knife.

3. The toner applicator of claim 1 wherein said toning channel also extends in a widthwise direction across said applicator body such that said toning applicator is a full width applicator.

* * * * *